US011067095B2

(12) United States Patent
Jarysek et al.

(10) Patent No.: US 11,067,095 B2
(45) Date of Patent: Jul. 20, 2021

(54) IMPELLER FOR A RADIAL FAN AND GAS BURNER APPLIANCE

(71) Applicant: Honeywell Technologies Sarl, Rolle (CH)

(72) Inventors: Kay Jarysek, Georgsmarienhuette (DE); Gerrit Wascher, Lotte (DE)

(73) Assignee: Honeywell Technologies Sarl, Rolle (CH)

( * ) Notice: Subject to any disclaimer, the term of this patent is extended or adjusted under 35 U.S.C. 154(b) by 180 days.

(21) Appl. No.: 16/285,059

(22) Filed: Feb. 25, 2019

(65) Prior Publication Data

US 2019/0264704 A1 Aug. 29, 2019

(30) Foreign Application Priority Data

Feb. 26, 2018 (EP) ..... 18158633

(51) Int. Cl.
*F04D 29/28* (2006.01)
*F04D 29/42* (2006.01)
(Continued)

(52) U.S. Cl.
CPC ..... *F04D 29/4226* (2013.01); *F04D 29/282* (2013.01); *F23D 14/28* (2013.01);
(Continued)

(58) Field of Classification Search
CPC .. F04D 29/4226; F04D 29/282; F04D 29/281; F04D 29/30; F04D 24/08; F23D 14/28; F23D 14/70; F23N 2233/06
See application file for complete search history.

(56) References Cited

U.S. PATENT DOCUMENTS 3,219,122 A 11/1965 Montgomerie et al.
3,479,017 A 11/1969 Thikoetter
(Continued)

FOREIGN PATENT DOCUMENTS

CN 1982726 A 6/2007
CN 102003416 A 4/2011
(Continued)

OTHER PUBLICATIONS

Extended Search Report from counterpart European Application No. 18158633.0, dated Aug. 31, 2018, 7 pp.

*Primary Examiner* — Igor Kershteyn
*Assistant Examiner* — Joshua R Beebe
(74) *Attorney, Agent, or Firm* — Shumaker & Sieffert, P.A.

(57) ABSTRACT

Impeller for a radial fan, the impeller comprising a front side, a rear side and a peripheral edge, a hub element, an annular covering disc positioned on the front side, an intake opening formed on the front side, a support disc positioned on the rear side, blades extending substantially radially from the hub element towards the peripheral edge, and outflow openings formed in the region of the peripheral edge. A first outer diameter of a radially outer edge of the annular covering disc is greater than a second outer diameter of a radially outer edge of the support disc. Openings are formed in the annular covering disc, wherein the openings are positioned between the radially outer edge of the annular covering disc having the first outer diameter and a radially inner edge of the annular covering disc having a first inside diameter.

20 Claims, 4 Drawing Sheets

(51) Int. Cl.
*F23D 14/28* (2006.01)
*F23D 14/70* (2006.01)

(52) U.S. Cl.
CPC ..... *F23D 14/70* (2013.01); *F05D 2270/30* (2013.01); *F23N 2233/06* (2020.01)

(56) References Cited

U.S. PATENT DOCUMENTS 5,971,709 A 10/1999 Hauser
6,731,082 B2 5/2004 Pelonis
7,002,311 B2 2/2006 Strike et al.
7,179,050 B2 * 2/2007 Hopfensperger ..... F04D 29/281 415/204
7,329,100 B2 * 2/2008 Kashiwazaki ..... F04D 25/082 415/206
7,616,440 B2 11/2009 Franz
8,225,623 B2 * 7/2012 Ikeda ..... F24F 1/01 62/419
8,667,774 B2 3/2014 Kuehn et al.
2002/0110455 A1 * 8/2002 Kim ..... F04D 29/30 416/196 R
2003/0053911 A1 * 3/2003 Sakai ..... F04D 29/30 415/206
2004/0247441 A1 * 12/2004 Kim ..... F04D 29/023 416/179
2007/0297922 A1 12/2007 Kanai et al.
2008/0118357 A1 * 5/2008 Jeon ..... F04D 29/282 416/185
2008/0292464 A1 11/2008 Keber et al.
2012/0213637 A1 * 8/2012 Jeon ..... F04D 29/162 416/185
2013/0224670 A1 * 8/2013 Zatti ..... F23D 14/04 431/38
2018/0238337 A1 8/2018 Kneip
2019/0242396 A1 * 8/2019 Ishii ..... F04D 29/28

FOREIGN PATENT DOCUMENTS

DE 202004012015 U1 12/2005
DE 202017103925 U1 2/2017
DE 202017103890 U1 7/2017
EP 1462658 A2 9/2004
EP 2196679 A2 6/2010
EP 2757268 A2 7/2014
FR 1420858 A 12/1965
JP 2005176529 A 6/2005
JP 2012140881 A 7/2012
WO 2015017040 A2 2/2015

* cited by examiner

IMPELLER FOR A RADIAL FAN AND GAS BURNER APPLIANCE

This Application claims priority to European Application Number 18158633.0, filed on Feb. 26, 2018, the entire content of which is incorporated herein by reference.

The present application relates to an impeller for a radial fan and to a gas burner appliance having a radial fan.

DE 20 2004 012 015 U1 discloses an impeller for a radial fan. This impeller comprises a front side, a rear side and a peripheral edge. This impeller further comprises a hub element and an annular covering disc positioned on the front side. An intake opening is formed on the front side. Outflow openings are formed in the region of to the peripheral edge. Blades extend substantially radially from the hub element to the peripheral edge. An outer diameter of a radially outer edge of the annular covering disc defines the maximum outside-diameter of the impeller.

EP 2 196 679 A2 discloses another impeller for a radial fan. The impeller disclosed by EP 2 196 679 A2 comprises a front side, a rear side and a peripheral edge. This impeller further comprises a hub element, an annular covering disc positioned on the front side and a support disc positioned on the rear side. An intake opening is formed on the front side. Outflow openings are formed in the region of the peripheral edge. Blades extend substantially radially from the hub element to the peripheral edge. An outer diameter of a radially outer edge of the support disc defines the maximum outside-diameter of the impeller. An outer diameter of a radially outer edge of the annular covering disc is smaller than the outer diameter of a radially outer edge of the support disc. Such an impeller is also disclosed by US 2004/0247441 A1.

U.S. Pat. No. 3,479,017 A discloses another impeller according to the prior art.

Against this background, a novel impeller for a radial fan is provided.

The impeller according to the present application is defined in the claim 1.

According to the present application, a first outer diameter of a radially outer edge of the annular covering disc is greater than a second outer diameter of a radially outer edge of the support disc. According to the present application, openings are formed in the annular covering disc, wherein the openings are positioned between the radially outer edge of the annular covering disc having the first outer diameter and a radially inner edge of the annular covering disc having a first inside diameter. Such an impeller can be manufactured as one monolithic piece while providing a good performance with a high efficiency and low noise during operation.

Preferably, the peripheral edge and thereby a maximum outside-diameter of the impeller is defined by the first outer diameter of the radially outer edge of the annular covering disc. Such an impeller can be manufactured as one monolithic piece while providing a high efficiency and low noise during operation of the same. Alternatively, the blades may protrude radially outwardly from the radially outer edge of the annular covering disc. In this case, the peripheral edge and thereby a maximum outside-diameter of the impeller is defined by an outer diameter of the blades.

The ratio A2/A1 between an axially effective surface area A2 of the support disc and an axially effective surface area of the annular covering disc may be in a range between 0.5 and 0.9. Preferably, the ratio A2/A1 is in a range between 0.6 and 0.8. Most preferred, the ratio A2/A1 is in a range between 0.65 and 0.75. Such a ratio A2/A1 is preferred to maximize efficiency of the impeller and to minimize noise of the impeller during operation of the same.

The openings formed within the annular covering disc are conically shaped, namely in such a way that the openings formed within the annular covering disc taper in axial direction towards the support disc. These details are preferred to provide an impeller that can be easily and reliably manufactured as one monolithic piece.

The gas burner appliance according to the present application is defined in the claim 15.

Preferred developments of the invention are provided by the dependent claims and the description which follows. Exemplary embodiments are explained in more detail on the basis of the drawing, in which:

Figure 1:
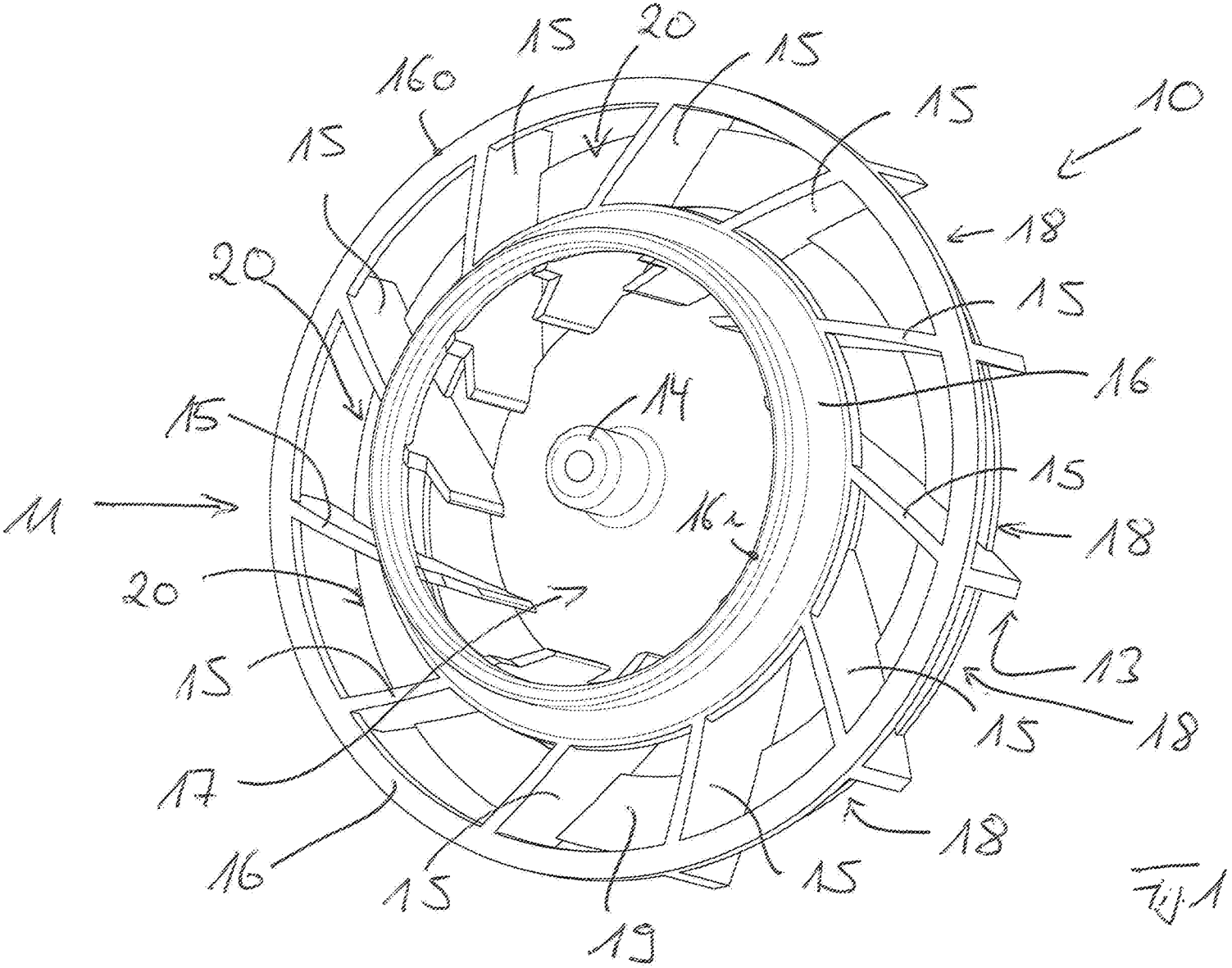
FIG. 1 shows a perspective view on a front side of an impeller for a radial fan according to the present application.
Figure 2:
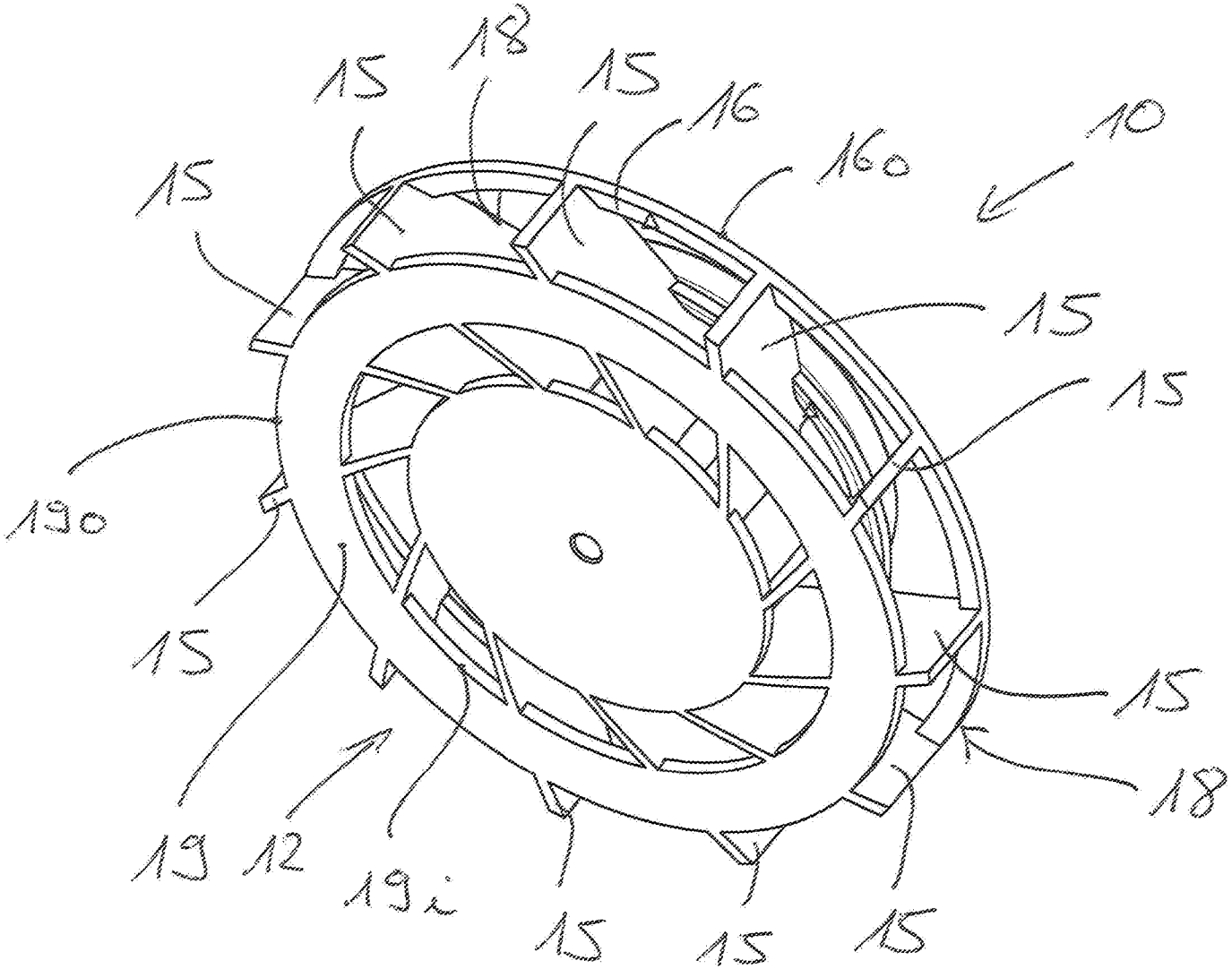
FIG. 2 shows a perspective view on a rear side of the impeller of FIG. 1.
Figure 3:
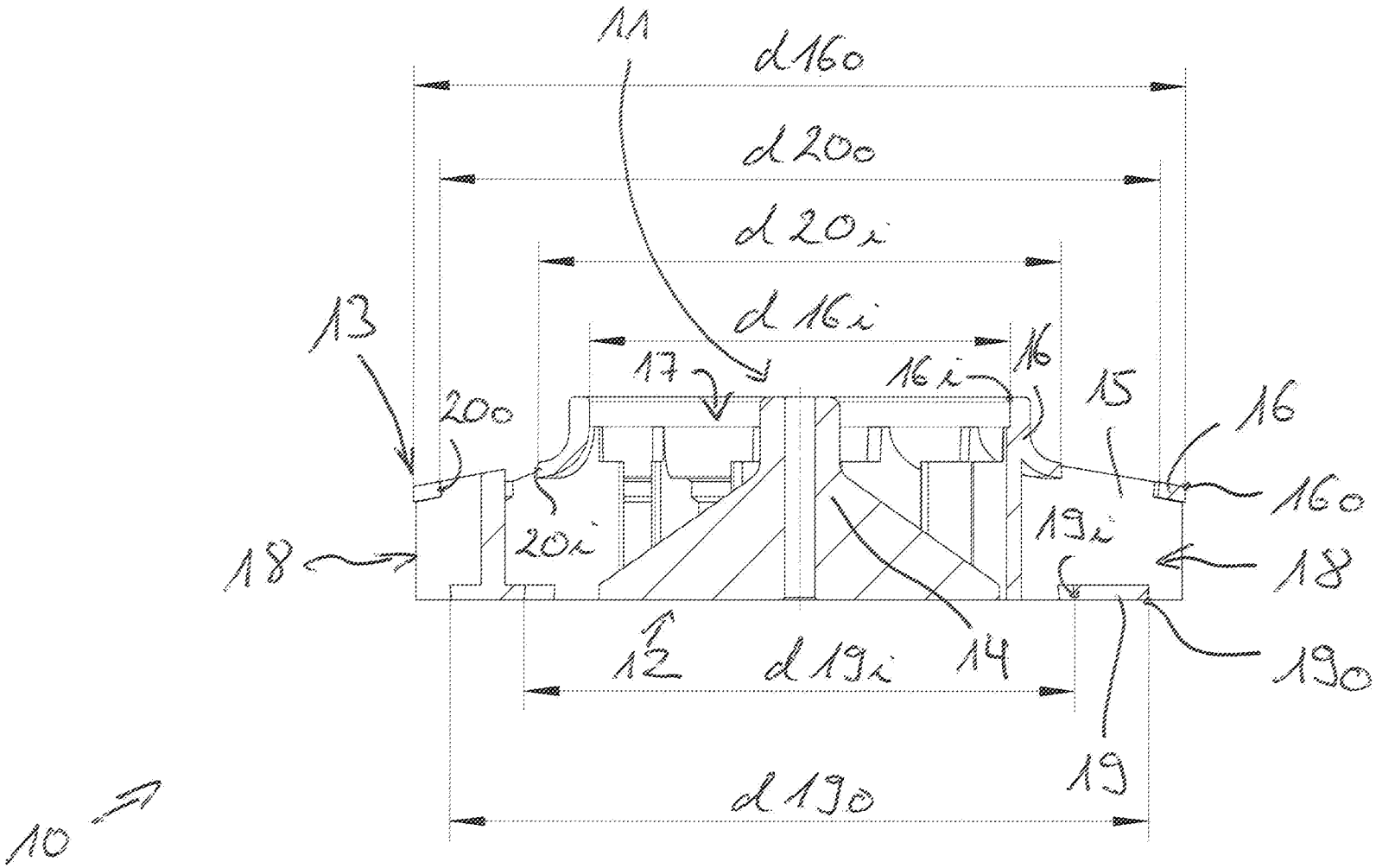
FIG. 3 shows a cross section through the impeller of FIGS. 1 and 2 showing geometrical parameters of the same.
Figure 4:
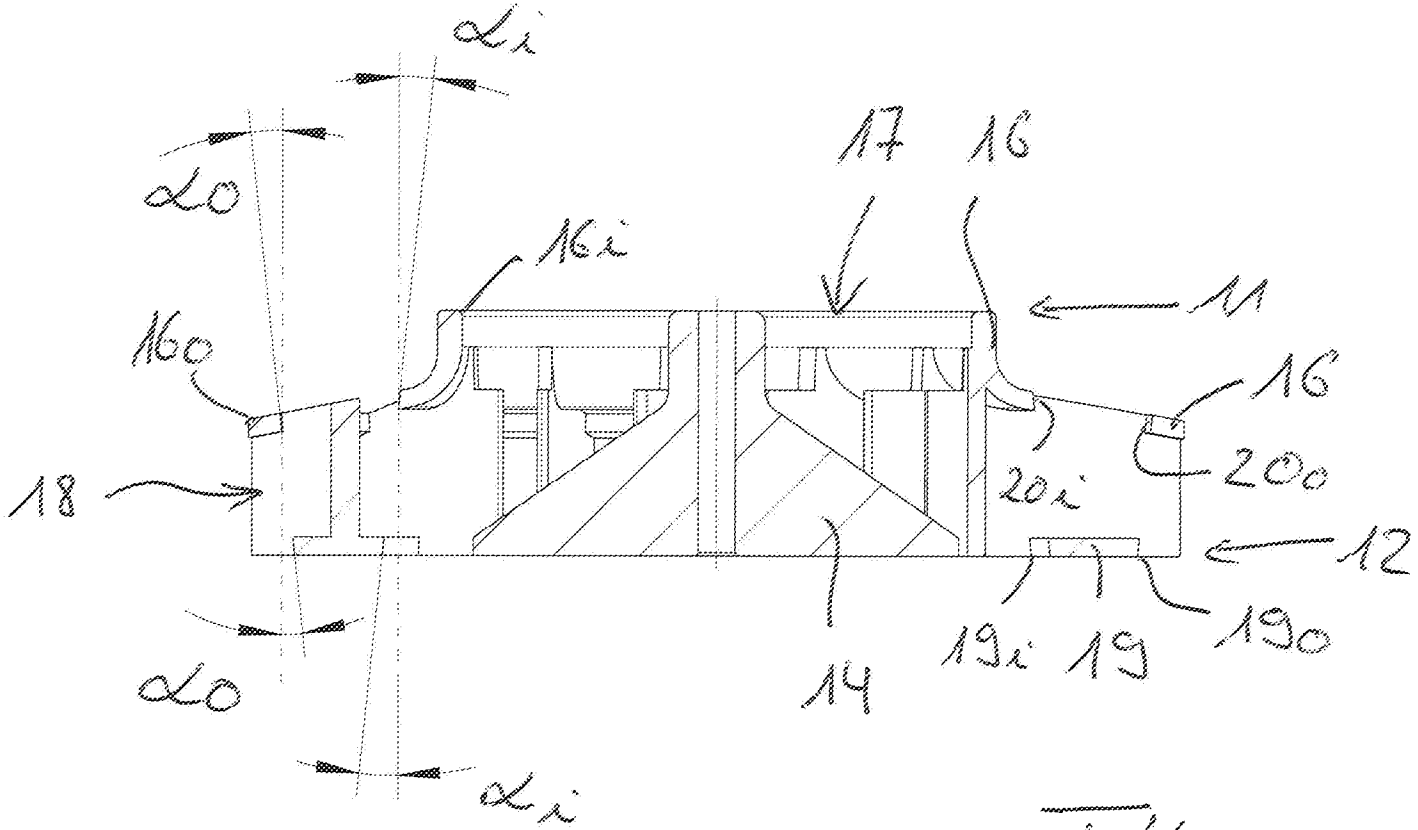
FIG. 4 shows the cross section of FIG. 3 with other geometrical parameters of the same.

The present application relates to an impeller for a radial fan. FIGS. 1 to 4 show different views of an impeller 10 according to the present application.

The impeller 10 comprises a front side 11, a rear side 12 and a peripheral edge 13. The impeller 10 comprises a hub element 14. The impeller 10 can be coupled to a shaft of a motor through said hub element 14. The impeller 10 comprises blades 15 extending substantially radially from the hub element 14 to the peripheral edge 13.

The impeller 10 comprises an annular covering disc 16 positioned on the front side 11. An intake opening 17 of the impeller 10 is formed on the front side 11.

Outflow openings 18 are formed in the region of to the peripheral edge 13. Between each two adjacent blades 15 there is defined one outflow opening 18.

A fluid like air or a gas/air mixture can be supplied by the impeller 10. The fluid flows through the intake opening 17 along the blades 15 towards the outflow openings 18.

The impeller 10 comprises a support disc 19 positioned on the rear side 12.

The annular covering disc 16 has a radially inner edge 16*i* with a first inside diameter d16*i* and a radially inner edge 16*o* with a first outer diameter d16*o*. The radially inner edge 16*i* of the annular covering disc 16 defines the intake opening 17 on the front side 11 of the impeller 10.

The support disc 19 has a radially inner edge 19*i* with a second inside diameter d19*i* and a radially outer edge 19*o* with a second outer diameter d19*o*.

According to the present invention, the first outer diameter d16*o* of the radially outer edge 16*o* of the annular covering disc 16 is greater the second outer diameter d19*o* of a radially outer edge 19*o* of the support disc 19.

According to the present invention, openings 20 are formed in the annular covering disc 16. The openings 20 are positioned between the radially outer edge 16*o* of the annular covering disc 16 having the first outer diameter d16*o* and a radially inner edge 16*i* of the annular covering disc 16 having the first inside diameter d16*i*. The first internal diameter d16*i* of the radially inner edge 16*i* of the annular covering disc 16 is smaller than a second internal diameter d19*i* of a radially inner edge 19*i* of the support disc 19.

Preferably, the peripheral edge 13 and thereby a maximum outer diameter of the impeller 10 is defined by the first outer diameter d16*o* of the radially outer edge 16*o* of the annular covering disc 16.

Alternatively, the blades 15 may protrude radially outwardly from the radially outer edge 16*o* of the annular covering disc 16. In this case, the peripheral edge 13 thereby a maximum outside-diameter of the impeller would be defined by an outer diameter of the blades 15.

The openings 20 formed within the annular covering disc 16 are defined by a radially inner edge 20*i* having a third internal diameter d20*i* and by a radially outer edge 20*o* having a third outer diameter d20*o*. The openings 20 are separated from each other by the blades 15. The third internal diameter d20*i* of the openings 20 is smaller than the second internal diameter d19*i* of the support disk 19. The third outer diameter d20*o* of the openings 20 is greater than the second internal diameter d19*o* of the support disk 19.

Such an impeller 10 can be manufactured as one monolithic piece while providing a high efficiency and low noise during operation of the same.

The annular covering disc 16 has an axially effective surface area A1. The support disc has an axially effective surface area A2. These axially effective surfaces A1, A2 can also be called axially projected surfaces.

The axially effective surface area A1 of the annular covering disc 16 is defined as follows:

$$A1=\pi*(r16o^2-r20o^2+r20i^2-r16i^2),$$

wherein $$r16o=0.5*d16o,$$

$$r20o=0.5*d20o,$$

$$r20i=0.5*d20,$$

$$r16i=0.5*d16i.$$

The axially effective surface area A2 of the support disc 19 is defined as follows:

$$A2=\pi*(r19o^2-r19i^2),$$

wherein $$r19o=0.5*d19o,$$

$$r19i=0.5*d19.$$

The ratio A2/A1 between an axially effective surface area A2 of the support disc 19 and an axially effective surface area A1 of the annular covering disc 16 is in a range between 0.5 and 0.9.

Preferably, the ratio A2/A1 is in a range between 0.6 and 0.8. Most preferred, the ratio A2/A1 is in a range between 0.65 and 0.75.

Such a ratio A2/A1 is preferred to maximize efficiency of the impeller 10 and to minimize noise of the impeller during operation of the same. Such a ratio A2/A1 allows a balancing of axial forces acting on the impeller 10 during operation of the same.

Preferably, the openings 20 formed within the annular covering disc 16 are conically shaped. The openings 20 formed within the annular covering disc 16 taper and thereby converge in axial direction towards the support disc 19. A conus angle of the openings 20 is in a range between 0.5° and 15°.

Preferably, the conus angle is in a range between 1.5° and 14°. Most preferred, the conus angle is in a range between 2° and 13°.

The conus angles of the openings 20 taper and thereby converge in axial direction from the front side 11 towards the rear side 12 of the impeller 10.

The conus angle αi of the openings 20 at a radial inner opening area is smaller than conus angle αo of the openings 20 at a radial outer opening area. However, both conus angles αi, αo are within the above defines ranges. Both conus angles αi, αo, with the conus angle αi being smaller than conus angle αo, are in a range between 0.5° and 15°, preferably is in a range between 1.5° and 14°, most preferred in a range between 2° and 13°.

Such conus angles are preferred to provide an impeller 10 that can be easily and reliably manufactured as one monolithic plastic piece by injection molding using a simple open-close tool. The use of such an open-close tool allows a cost-effective manufacturing of the impeller 10 by providing short manufacturing cycle times.

The impeller 10 according to the present invention is an impeller of a radial fan. Such a radial fan is part of a gas burner appliance having a boiler, a gas/air mixing device and the radial fan. The gas/air mixing device mixes gas and air thereby providing a gas/air mixture. The radial fan provides the gas/air mixture to a gas burner chamber of the boiler. The gas/air mixture becomes combusted within the gas burner chamber of the boiler. The boiler may be a condensing boiler. In such an application the impeller provides a good gas/air mixing performance with a high efficiency and low noise during operation.

LIST OF REFERENCE SIGNS

10 impeller
11 front side
12 rear side
13 peripheral edge
14 hub element
15 blade
16 annular covering disc
16*i* radially inner edge
16*o* radially outer edge
17 intake opening
18 outflow openings
19 support disc
19*i* radially inner edge
19*o* outer edge
20 opening
20*i* radially inner edge
20*o* radially outer edge

The invention claimed is:

1. An impeller for a radial fan, the impeller comprising:
a front side, a rear side and a peripheral edge;
a hub element;
an annular covering disc positioned on the front side;
an intake opening formed on the front side;
a support disc positioned on the rear side, the support disc having a radially outer edge and a radially inner edge;
blades extending substantially radially from the hub element towards the peripheral edge; and
outflow openings formed in the region of the peripheral edge, wherein:
a first outer diameter of a radially outer edge of the annular covering disc is greater than a second outer diameter of the radially outer edge of the support disc,
openings are formed in the annular covering disc, wherein the openings are positioned between the radially outer edge of the annular covering disc having the first outer diameter and a radially inner edge of the annular covering disc having a first inside diameter, and the second outer diameter of the radially outer edge of the support disc is less than an outer diameter of the blades.

2. The impeller of claim 1, wherein the peripheral edge and thereby a maximum outside-diameter of the impeller is defined by the first outer diameter of the radially outer edge of the annular covering disc.

3. The impeller of claim 1, wherein the blades protrude radially outwardly from the radially outer edge of the annular covering disc so that a maximum outside-diameter of the impeller is defined by the outer diameter of the blades.

4. The impeller of claim 1, wherein the radially inner edge of the annular covering disc having the first inside diameter defines the intake opening formed on the front side.

5. The impeller of claim 1, wherein the first inside diameter of the radially inner edge of the annular covering disc is smaller than a second inside diameter of the radially inner edge of the support disc.

6. The impeller of claim 1, wherein a ratio A2/A1 between an axially effective surface area A2 of the support disc and an axially effective surface area (A1) of the annular covering disc is in a range between 0.5 and 0.9.

7. The impeller of claim 6, wherein the ratio A2/A1 is in a range between 0.6 and 0.8.

8. The impeller of claim 6, wherein the ratio A2/A1 is in a range between 0.65 and 0.75.

9. The impeller of claim 1, wherein the openings formed within the annular covering disc are defined by a radially inner edge of the openings having a third internal diameter and by a radially outer edge of the openings having a third outer diameter.

10. The impeller of claim 9, wherein:

the third internal diameter is smaller than a second inside diameter of the radially inner edge of the support disc, and the third outer diameter is greater than the second outer diameter of the radially outer edge of the support disc.

11. The impeller of claim 1, wherein the openings formed within the annular covering disc are conically shaped.

12. The impeller of claim 11, wherein the openings formed within the annular covering disc taper in axial direction towards the support disc.

13. The impeller of claim 11, wherein a conus angle of the openings is in a range between 0.5° and 15°.

14. The impeller of claim 13, wherein a conus angle $\alpha i$ of the openings at a radial inner opening area is smaller than a conus angle $\alpha o$ of the openings at a radial outer opening area.

15. A gas burner appliance comprising a boiler having a gas burner chamber;

a gas/air mixing device mixing gas and air thereby providing a gas/air mixture; and a radial fan comprising the impeller according to claim 1, wherein the radial fanis configured to provide the gas/air mixture to the gas burner chamber of the boiler for combusting the gas/air mixture within the gas burner chamber.

16. An impeller for a radial fan, the impeller comprising:

a front side, a rear side and a peripheral edge;

a hub element;

an annular covering disc positioned on the front side;

an intake opening formed on the front side;

a support disc positioned on the rear side;

blades extending substantially radially from the hub element towards the peripheral edge; and outflow openings formed in the region of the peripheral edge, wherein:

a first outer diameter of a radially outer edge of the annular covering disc is greater than a second outer diameter of a radially outer edge of the support disc, and openings are formed in the annular covering disc, wherein the openings are positioned between the radially outer edge of the annular covering disc having the first outer diameter and a radially inner edge of the annular covering disc having a first inside diameter, wherein the openings formed within the annular covering disc are conically shaped, and wherein a conus angle of the openings is in a range between 0.5° and 15°.

17. The impeller of claim 16, wherein the support disc includes a radially outer edge and a radially inner edge, and wherein the first inside diameter of the radially inner edge of the annular covering disc is smaller than a second inside diameter of the radially inner edge of the support disc.

18. The impeller of claim 16, wherein the peripheral edge and thereby a maximum outside-diameter of the impeller is defined by the first outer diameter of the radially outer edge of the annular covering disc.

19. The impeller of claim 16, wherein the blades protrude radially outwardly from the radially outer edge of the annular covering disc so that a maximum outside-diameter of the impeller is defined by an outer diameter of the blades.

20. A gas burner appliance comprising a boiler having a gas burner chamber;

a gas/air mixing device mixing gas and air thereby providing a gas/air mixture; and a radial fan comprising the impeller according to claim 16, wherein the radial fan is configured to provide the gas/air mixture to the gas burner chamber of the boiler for combusting the gas/air mixture within the gas burner chamber.

* * * * *